US007511425B2

(12) United States Patent
Tsuda et al.

(10) Patent No.: US 7,511,425 B2
(45) Date of Patent: Mar. 31, 2009

(54) IMAGE DISPLAY APPARATUS HAVING ION PUMP AND ELECTRON-EMITTING DEVICES IN COMMUNICATION VIA MESH OR STRIPE SHAPED MEMBER

(75) Inventors: Hisanori Tsuda, Atsugi (JP); Masaru Kamio, Sagamihara (JP); Ihachiro Gofuku, Chigasaki (JP); Yasue Sato, Machida (JP); Yoshiyuki Shimada, Fukaya (JP); Hiromasa Mitani, Hiratsuka (JP); Kazuyuki Seino, Fukaya (JP); Takashi Nishimura, Fukaya (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 564 days.

(21) Appl. No.: 11/210,814

(22) Filed: Aug. 25, 2005

(65) Prior Publication Data

US 2006/0043866 A1 Mar. 2, 2006

(30) Foreign Application Priority Data

Aug. 27, 2004 (JP) ..... 2004-248612

(51) Int. Cl.
*H01J 17/24* (2006.01)
*H01J 19/70* (2006.01)

(52) U.S. Cl. ..... 313/549; 313/545; 313/547; 313/552; 313/560; 313/313; 313/239

(58) Field of Classification Search ..... 313/481, 313/545, 547, 549, 552, 553, 560, 562, 313, 313/239
See application file for complete search history.

(56) References Cited

U.S. PATENT DOCUMENTS 5,563,407 A * 10/1996 Yamagishi ..... 250/214 VT
5,936,342 A 8/1999 Ono et al. ..... 313/495
6,582,268 B1 * 6/2003 Jindai et al. ..... 445/6
6,616,417 B2 9/2003 Shen
6,726,520 B2 4/2004 Takeda et al. ..... 445/62
6,827,621 B1 12/2004 Enomoto et al. ..... 445/24
6,846,213 B2 * 1/2005 Sato ..... 445/6
6,848,961 B2 2/2005 Nomura et al. ..... 445/24
7,091,662 B2 8/2006 Hasegawa et al. ..... 313/555
7,301,269 B2 * 11/2007 Gofuku et al. ..... 313/495

(Continued)

FOREIGN PATENT DOCUMENTS

CN 1366706 8/2002

(Continued)

*Primary Examiner*—Peter Macchiarolo
(74) *Attorney, Agent, or Firm*—Fitzpatrick, Cella, Harper & Scinto

(57) ABSTRACT

In an image display apparatus composed of a vacuum container having an electron source composed of multiple electron-emitting devices and a phosphor film that is irradiated with an electron from the electron source to emit light for display, an ion pump for exhausting the vacuum container through a communicating path by virtue of an action of a magnetism forming portion is arranged. A magnetic shielding member is arranged in a space where the ion pump and the electron-emitting devices are in communication with each other, whereby an influence of a magnetic field generated by the magnetism forming portion on the trajectory of an electron emitted from any one of the electron-emitting devices and display luminance unevenness incidental to the influence are removed.

6 Claims, 5 Drawing Sheets

U.S. PATENT DOCUMENTS

| | | | | |
|---|---|---|---|---|
| 2005/0009433 | A1 | 1/2005 | Nomura et al. | 445/24 |
| 2006/0043865 | A1 | 3/2006 | Gofuku et al. | 313/362.1 |
| 2006/0043870 | A1 | 3/2006 | Tsuda et al. | 313/495 |
| 2006/0043871 | A1* | 3/2006 | Kamio et al. | 313/495 |
| 2006/0049734 | A1 | 3/2006 | Sato et al. | 313/153 |
| 2006/0055637 | A1 | 3/2006 | Gofuku et al. | 345/75.2 |
| 2006/0087220 | A1* | 4/2006 | Hiroki et al. | 313/495 |
| 2007/0236143 | A1* | 10/2007 | Katagiri et al. | 313/549 |

FOREIGN PATENT DOCUMENTS

| | | |
|---|---|---|
| CN | 13667006 | 8/2002 |
| JP | 5-121012 | 5/1993 |
| JP | 7-142019 | 6/1995 |
| JP | 9-82245 | 3/1997 |
| JP | 09-213261 | 8/1997 |
| JP | 2000-133136 | 5/2000 |
| JP | 2000-315458 | 11/2000 |

* cited by examiner

IMAGE DISPLAY APPARATUS HAVING ION PUMP AND ELECTRON-EMITTING DEVICES IN COMMUNICATION VIA MESH OR STRIPE SHAPED MEMBER

BACKGROUND OF THE INVENTION

1. Field of the Invention

The present invention relates to an image display apparatus using an electron-emitting device.

2. Background Art

In a flat display in which: a large number of electron-emitting devices are arranged as electron sources on a flat substrate; a phosphor as an image forming member on an opposing substrate is irradiated with electron beams emitted from the electron sources; and the phosphor is allowed to emit light to display an image, the inside of a vacuum container including the electron sources and the image forming member must be kept at a high vacuum. When a gas is generated in the vacuum container to increase the pressure in the container, the increase adversely affects the electron sources to reduce an electron emission amount, thereby making it impossible to display a clear image, although the degree of the adverse effect varies depending on the kind of the gas.

In particular, the following problems are characteristic of a flat display. A gas generated from an image display member accumulates near an electron source before it reaches a getter placed outside an image display area, so a local increase in pressure and the deterioration of the electron source incidental to the local increase occur. Japanese Patent Application Laid-Open No. H09-82245 describes that a getter is arranged in an image display area to immediately adsorb a generated gas, thereby suppressing the deterioration and breakage of a device. Japanese Patent Application Laid-Open No. 2000-133136 describes a structure in which a non-evaporable getter is arranged in an image display area and a evaporable getter is arranged outside the image display area. Furthermore, Japanese Patent Application Laid-Open No. 2000-315458 proposes that a series of operations consisting of degassing, getter formation, and seal bonding (making a vacuum container) are performed in a vacuum chamber.

Getters are classified into a evaporable getter and a non-evaporable getter. The evaporable getter shows an extremely large exhaust velocity with respect to water or oxygen. However, each of the evaporable getter and the non-evaporable getter shows an exhaust velocity close to zero with respect to an inert gas such as argon (Ar). An argon gas is ionized by an electron beam to generate a plus ion. The plus ion is accelerated in an electric field for accelerating an electron to be bombarded with an electron source, thereby damaging the electron source. Furthermore, the argon ion may cause discharge inside an apparatus to break the apparatus.

Meanwhile, Japanese Patent Application Laid-Open No. H05-121012 describes a method involving connecting a sputter ion pump to a vacuum container of a flat display to maintain a high vacuum for a long period of time. However, the method requires a strong magnet, so the electron trajectory of the display is curved in a magnetic field to affect an image.

SUMMARY OF THE INVENTION

The present invention has been made with a view to solving the above problems, and therefore an object of the present invention is to provide: an image display apparatus which reduces an influence of a magnetic field when an ion pump is used, which has small luminance unevenness due to the influence of the magnetic field in an image forming area, and which shows a small change in luminance with time; and a method of producing the image display apparatus.

According to one aspect of the present invention, there is provided an image display apparatus, including: a vacuum container formed of at least an electron source substrate on which multiple electron-emitting devices are arranged and an image forming substrate which is arranged so as to be opposite to the electron source substrate and which has a phosphor film and an anode electrode film; (a) an ion pump having an ion pump casing and magnetic field forming means, the ion pump casing being connected with the vacuum container through a communicating path arranged on at least one of the electron source substrate and the image forming substrate to maintain a pressure inside the ion pump casing at a reduced pressure; and (b) a first magnetic shielding member arranged in a space where the ion pump and the electron-emitting devices are in communication with each other.

BRIEF DESCRIPTION OF THE DRAWINGS

FIGS. 2A, 2B-1, and 2B-2 are views each showing a first magnetic shielding member;

DESCRIPTION OF THE PREFERRED EMBODIMENTS

The present invention relates to an image display apparatus, including: a vacuum container formed of at least an electron source substrate on which multiple electron-emitting devices are arranged and an image forming substrate which is arranged so as to be opposite to the electron source substrate and which has a phosphor film and an anode electrode film; (a) an ion pump having an ion pump casing and magnetic field forming means, the ion pump casing being connected with the vacuum container through a communicating path arranged on at least one of the electron source substrate and the image forming substrate to maintain a pressure inside the ion pump casing at a reduced pressure; and (b) a first magnetic shielding member arranged in a space where the ion pump and the electron-emitting devices are in communication with each other.

In the present invention, the first magnetic shielding member is preferably structured to allow a gas to flow between the vacuum container and the ion pump casing.

According to the structure of the image display apparatus of the present invention, the magnetic shielding member is arranged in a vacuum between each of the electron-emitting devices and the ion pump, so an influence of a magnetic field leaking from the communicating path to which the ion pump casing is attached and the vicinity of the communicating path on an electron can be suppressed to an extremely low level. Accordingly, there can be provided an image display apparatus in which the trajectory of an electron from an electron-emitting device to a phosphor is not curved, which shows nearly no reduction in luminance, and which shows small luminance unevenness.

In addition, a gas can flow between the vacuum container and the ion pump casing, so the requisite exhaust velocity of the ion pump can be obtained, and changes in properties of a device with time can be suppressed.

Hereinafter, preferred embodiments will be described in detail with reference to the drawings. The image display apparatus of the present invention will be described with reference to FIGS. 1 to 7. In the following description, an electron source substrate is referred to as a rear plate, and an image forming substrate is referred to as a face plate.

<Description of Magnetic Shielding of Ion Pump>

Figure 1:
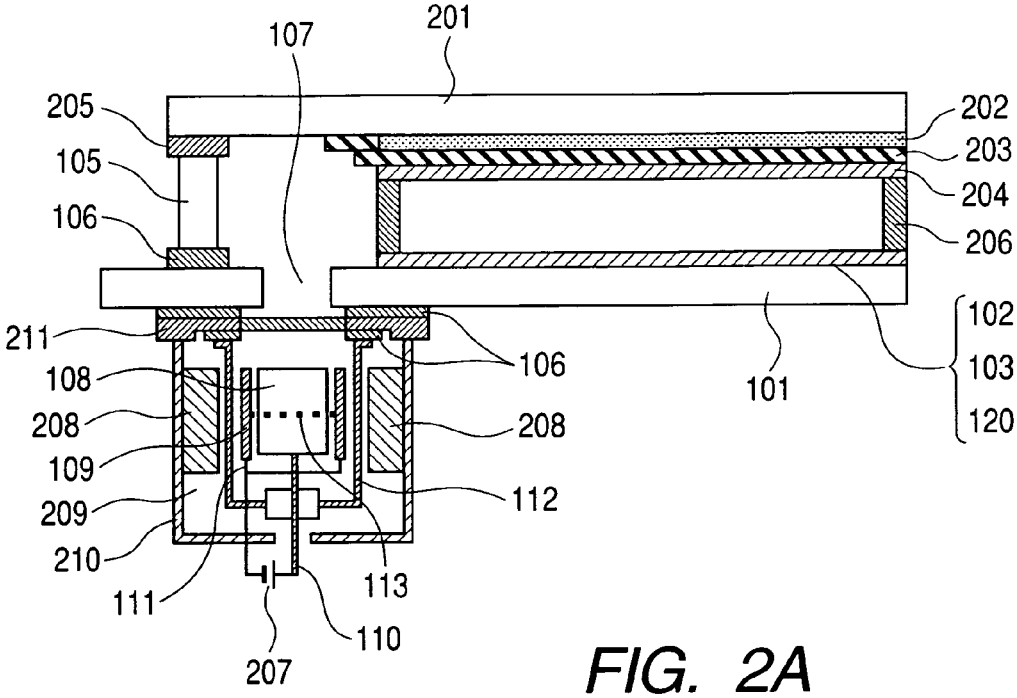
FIG. 1 is a sectional structural view showing an image display apparatus according to an embodiment of the present invention.
Figure 2A:
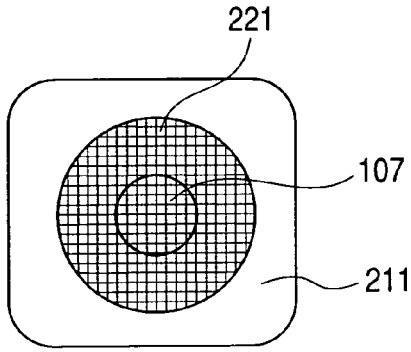
Figures 1, 2B:
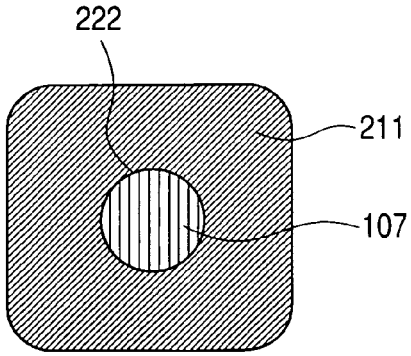
Figures 2, 2B:
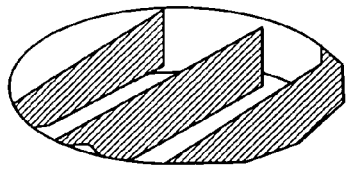
Figure 3:
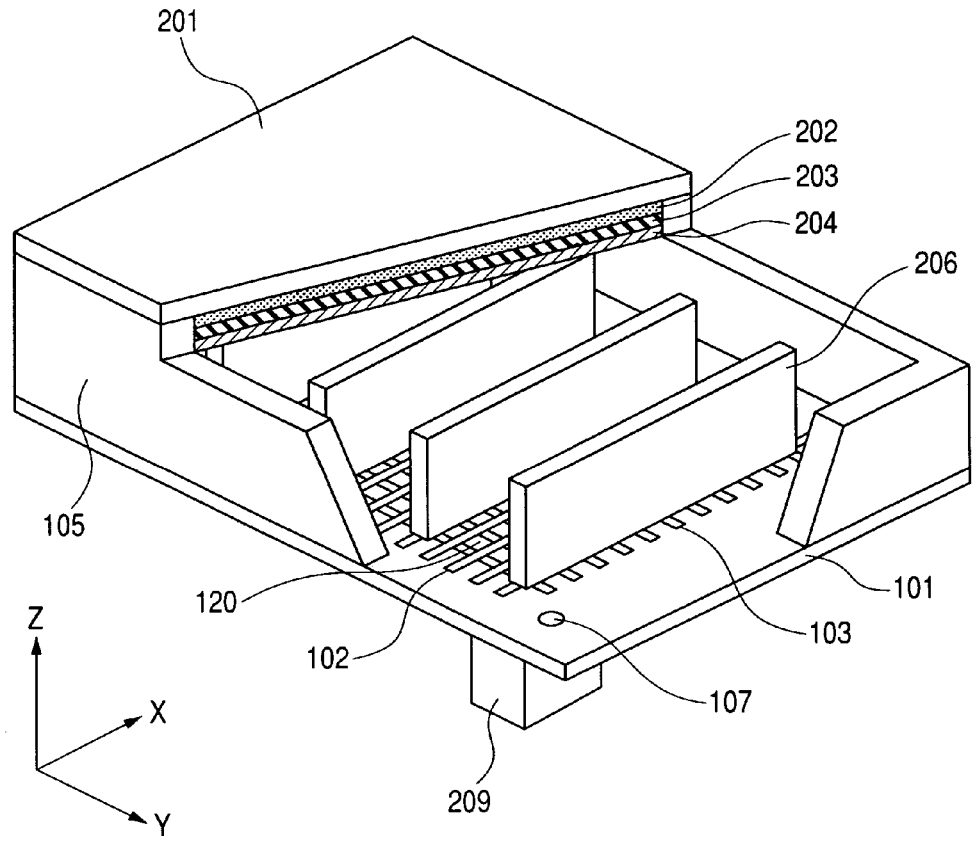
FIG. 3 is a schematic view showing the structure of an image display apparatus to which the present invention is applicable.

FIGS. 1 to 3 each schematically show an example of the structure of the image display apparatus of the present invention. As shown in FIG. 1, a rear plate 101 includes an upper wiring 102, a lower wiring 103, and a surface conduction electron-emitting device (electron source) 120 as an electron-emitting member in which an electron-emitting portion is formed, the upper wiring 102, the lower wiring 103, and the surface conduction electron-emitting device 120 being formed inside a transparent glass substrate. A face plate 201 has a phosphor film 202 applied to the inside of the transparent glass substrate, a metal back film 203 as an anode electrode film, and a getter film 204. A support 105 is connected to the rear plate 101 through a frit glass 106. An ion pump 209 is connected to an exhaust port 107 of the rear plate 101 through the frit glass 106. The support 105 and the face plate 201 are heated and seal-bonded in a vacuum by means of a metal such as indium 205 to constitute an envelope as a vacuum container.

The ion pump 209 includes an anode electrode 108, a cathode electrode 109, an anode connection terminal 110, and a cathode connection terminal 111, which are fixed and included inside an ion pump casing 112. A magnet 208 is placed outside the ion pump casing 112. The anode connection terminal 110 and the cathode connection terminal 111 are wired and connected to an ion pump power source 207 for driving an ion pump. The magnet 208 serves as magnetic field forming means. In this example, a permanent magnet is used, but magnetic field forming means such as an electromagnet may also be used.

As shown in FIG. 1, the magnetic field forming means is generally arranged outside the ion pump casing, and the outside is surrounded by a shield case 210 as a second magnetic shielding member. A base plate 211 of the shield case corresponds to the first magnetic shielding member of the present invention, and is in communication with the communicating path 107 for exhaustion arranged in the vacuum container (the rear plate in this example), so a gas can flow and a function of an ion pump is exerted. A portion in communication with the communicating path 107 has one or more flowing through holes to enable a gas to flow. The flowing through hole may have any shape as long as a magnetic shielding function is not impaired and a gas is allowed to flow. Examples of the shape of the flowing through hole include a mesh shaped member 221 shown in FIG. 2A and a stripe shaped member 222 shown in FIG. 2B-1. To secure a sufficient shielding ability and a sufficient exhausting ability, an opening interval of a mesh is, for example, preferably 0.1 mm to 5 mm, or further preferably 0.5 mm to 3 mm. A stripe interval is preferably 0.3 mm to 30 mm, or further preferably 1 mm to 10 mm. It is also effective to thicken the mesh shaped member or the stripe shaped member in a thickness direction (a direction perpendicular to the paper surface of each of FIG. 2A and FIG. 2B-1). The thickness is, for example, preferably 0.3 mm to 30 mm, or further preferably 1 mm to 10 mm. Increasing the thickness can prevent magnetism leakage to an increased degree and can increase an opening ratio. In particular, as shown in FIG. 2B-2, a stripe interval is preferably equal to or shorter than the thickness. A magnetic shielding ability of, for example, about −20 dbV suffices to be used.

An example of a method of placing the first magnetic shielding member involves: arranging the first magnetic shielding member so as to be in close contact with the communicating path 107, to thereby cover the communicating path 107 as shown in FIG. 1 and FIG. 2A; and bonding a portion having no flowing through hole to the vacuum container around the communicating path 107 to keep airtightness. Alternatively, as shown in FIG. 2B-1 and FIG. 2B-2, the first magnetic shielding member may be inserted into a hole of the communicating path 107, and furthermore, may reach the inside of the vacuum container beyond the thickness of the rear plate or the face plate.

As described above, with regard to the first magnetic shielding member, it is preferable that a member having a flowing through hole such as a mesh member or a stripe member be arranged in an opening of a flat plate and a portion of the flat plate except the opening be directly bonded to a vacuum container around the communicating path in an airtight fashion.

The shield case as the second magnetic shielding member has only to be structured so as to reduce an influence of a magnetic field from the magnetic field forming means on an electron-emitting device. In addition to a plate-like material, a material having flowability such as a mesh can be used as long as a required shielding effect can be expected from the material. In one embodiment of the present invention, the magnetic field forming means and the ion pump casing are preferably covered from outside with the second magnetic shielding member except for a portion requiring connection with an outside such as a leading portion of the cathode terminal or of the anode terminal.

The second magnetic shielding member is preferably bonded with the first magnetic shielding member. In particular, those two magnetic shielding members preferably cooperate with each other to surround the magnetic field forming means.

In a preferred embodiment, as shown in FIG. 1, the first magnetic shielding member is the base plate of the shield case, the second shielding member is the shield case, the ion pump casing is bonded to the base plate, the ion pump casing and the magnetic field forming means are surrounded by the shield case, and the shield case and the base plate are connected. From a magnetic point of view, the shield case and the base plate have only to be close to or in contact with each other in such a manner that magnetism leakage is small (preferably, nearly no magnetism leakage occurs). From a mechanical point of view, the shield case and the base plate are preferably bonded and fixed to each other. In such embodiment, the first magnetic shielding member and the second magnetic shielding member cooperate with each other to spatially envelope the magnetic field forming means. The expression "spatially envelope" does not necessarily mean to closely cover. As described above, a mesh or a stripe is used for the first shielding member, and a mesh material or the like is used for the second magnetic shielding member in some cases. In short, the magnetic field forming means is surrounded by the members in such a manner that magnetism leakage is small. The base plate 211 of the magnetic shield case may be joined with the rear plate 101 or the like in advance independent of the ion pump 209 or may be joined with the rear plate or the like after the ion pump is attached to the base plate, or the base plate and the ion pump may be joined in the same step.

Materials for the first magnetic shielding member and the second magnetic shielding member can be appropriately selected from materials each having a magnetic shielding action. In the case where the first magnetic shielding member is joined in the form of a base plate with the vacuum container as shown in FIG. 1, a material having high heat resistance is preferable when the joining is performed by means of a material requiring an operation at a high temperature such as frit glass, and an example of such preferable material includes a permalloy. Soft magnetic iron bar and sheet, electrolytic iron foil, a silicon steel plate, an amorphous alloy, a nano-crystalline soft magnetic material, and the like may also be used. A method involving bonding at a relatively low temperature is preferably used when any one of the above materials is used.

<Overall Description of Image Display Apparatus>

Next, an entire image display apparatus will be described. In FIG. 3, a modulation signal input and a scanning signal input are applied from terminals outside a container (not shown) through the lower wiring 103 and the upper wiring 102, respectively, and a high voltage is applied at a high voltage terminal Hv (not shown) to display an image. The ion pump 209 is connected with the vacuum container through the exhaust port 107, and is driven by a power source for driving the ion pump (not shown) to exhaust a released gas. In the figure, a surface conduction electron-emitting device 120 serves as an electron source, and the upper (Y directional) and lower (X directional) wirings 102 and 103 are connected with a pair of device electrodes of the surface conduction electron-emitting device.

Figure 4A:
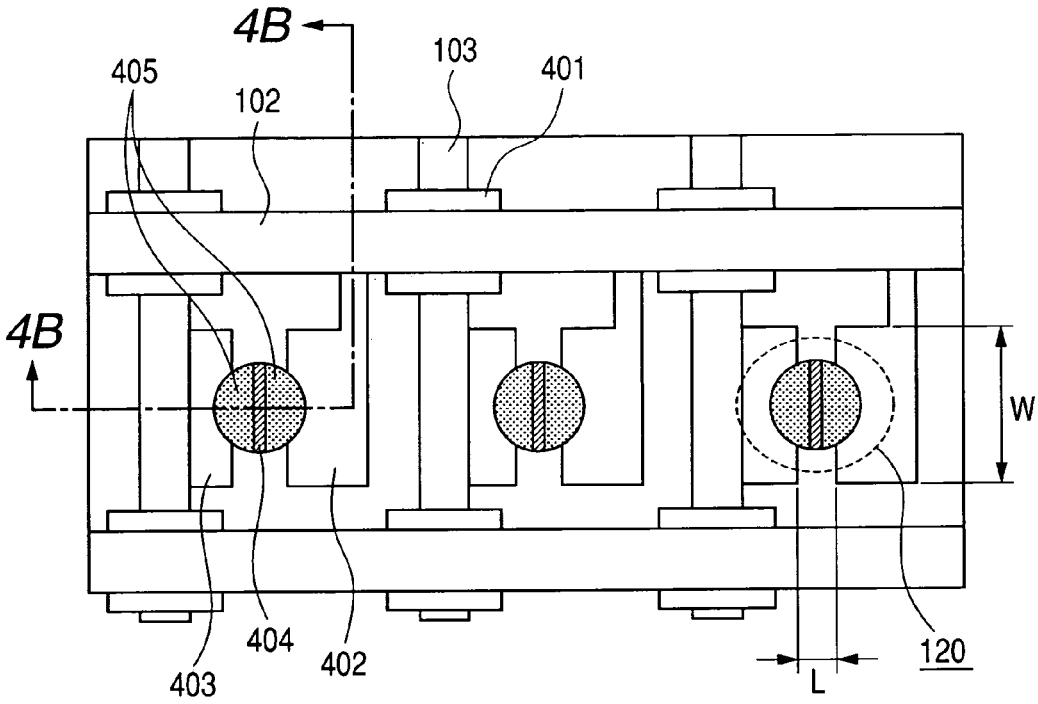
FIGS. 4A and 4B are views for explaining an electron source.

FIG. 4A is a schematic view partly showing the surface conduction electron-emitting device 120 as an electron source placed on the rear plate 101, a wiring for driving the electron source, and the like. In the figure, reference numeral 103 denotes a lower wiring; 102, an upper wiring; and 401, an interlayer insulator for electrically insulating the upper wiring 102 and the lower wiring 103 with each other.

Figure 4B:
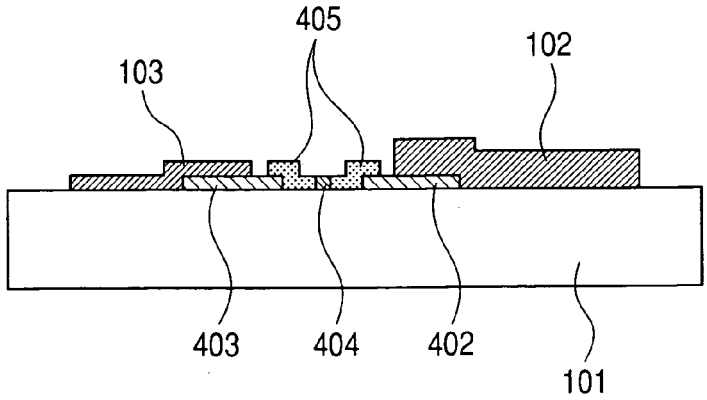

FIG. 4B is an enlarged view of the section taken along the line 4B-4B of the structure of the surface conduction electron-emitting device 120 of FIG. 4A. Reference numerals 402 and 403 each denote a device electrode; 405, an electroconductive thin film; and 404, an electron-emitting portion.

First, an example of an image display apparatus using a surface conduction electron-emitting device will be described.

In the structure shown in each of FIGS. 2A, 2B-1, 2B-2 and 3, an insulating substrate such as a glass substrate having soda glass, borosilicate glass, quartz glass, $SiO_2$, or the like formed on its surface, or a ceramic substrate (for example, alumina) is used as the rear plate 101, and a glass substrate such as transparent soda glass is used as the face plate 201.

A general conductor is used as a material for each of the device electrodes (corresponding to 402 and 403 of FIGS. 4A and 4B) of the surface conduction electron-emitting device 120. For example, the general conductor is selected from: a metal such as Ni, Cr, Au, Mo, W, Pt, Ti, Al, Cu, or Pd, or an alloy thereof; a printed conductor composed of a metal such as Pd, Ag, Au, $RuO_2$, or Pd—Ag, or an oxide thereof, and glass; a transparent conductor such as $In_2O_3$—$SnO_2$; and a semiconductor material such as polysilicon.

A device electrode can be produced by: forming any one of the electrode materials into a film by means of vacuum evaporation, sputtering, chemical vapor deposition, or the like; and processing the film into a desired shape by means of any one of photolithography techniques (including processing techniques such as etching and lift-off) and other printing methods. In short, it is sufficient that any one of the device electrode materials be formed into a desired shape, and a production method for a device electrode is not particularly limited.

A device electrode interval L shown in FIG. 4A is preferably several hundred nanometers to several hundred micrometers. The device electrode interval L is more preferably several micrometers to several ten micrometers because the device electrodes must be produced with good reproducibility. A device electrode length W is preferably several micrometers to several hundred micrometers in terms of the value of resistance, electron emission property, and the like of the electrode. The thickness of each of the device electrodes 402 and 403 is preferably several ten nanometers to several micrometers. In addition to the structure shown in FIG. 4B, the electroconductive thin film 405, and the device electrodes 402 and 403 may be formed in this order on the rear plate 101.

The electroconductive thin film 405 is particularly preferably a fine grain film composed of fine grains in order to obtain good electron emission property. The thickness of the electroconductive thin film 405, which is set depending on step coverage to the device electrodes 402 and 403, the value of resistance between the device electrodes 402 and 403, an energization forming condition to be described later, and the like, is preferably 0.1 nm to several hundred nanometers, or particularly preferably 1 nm to 50 nm. The value of resistance Rs of the electroconductive thin film is in the range of $10^2$ to $10^7$ Ω/μm. The value of Rs satisfies the relationship of R=Rs (l/w) where R represents the resistance of a thin film having a thickness of t, a width of w, and a length of l.

Examples of a material composing the electroconductive thin film 405 include: a metal such as Pd, Pt, Ru, Ag, Au, Ti, In, Cu, Cr, Fe, Zn, Sn, Ta, W, or Pb; an oxide such as PdO, $SnO_2$, $In_2O_3$, PbO, or $Sb_2O_3$; a boride such as $HfB_2$, $ZrB_2$, $LaB_6$, $CeB_6$, $YB_4$, or $GdB_4$; a carbide such as TiC, ZrC, HfC, TaC, SiC, or WC; a nitride such as TiN, ZrN, or HfN; a semiconductor such as Si or Ge; and carbon.

The term "fine grain film" as used herein refers to a film formed as a result of agglomeration of multiple fine grains. The fine structure of the film may be such that fine grains are individually dispersed and arranged, or may be such that fine grains are adjacent to or overlapped with each other (including an island-like film). The fine grains each have a diameter of 0.1 nm to several hundred nanometers, or preferably 1 nm to 20 nm.

A method of producing the electroconductive thin film 405 involves: applying an organometallic solution to the rear plate 101 on which the device electrodes 402 and 403 are arranged; and drying the applied solution to form an organometallic thin film. The term "organometallic solution" as used herein refers to a solution of an organometallic compound mainly composed of a metal for forming the electroconductive thin film 405.

After that, the organometallic thin film is heated and burned, and the resultant is subjected to patterning by means of lift-off, etching, or the like to form the electroconductive thin film 405. A method involving applying an organometallic solution has been described as a method of forming the electroconductive thin film 405. However, the method of forming the electroconductive thin film 405 is not limited thereto. The electroconductive thin film 405 may be formed by means of vacuum evaporation, sputtering, chemical vapor deposition, dispersion coating, dipping, a spinner method, or the like. The electron-emitting portion 404 is a crack having a high resistance formed in part of the electroconductive thin film 405, and is formed by a treatment called energization forming. The energization forming involves energizing a space between the device electrodes 402 and 403 by means of an electrode (not shown) to locally break, deform, or denature the electroconductive thin film 405, thereby changing and forming a structure. A voltage wave form at the time of energization is preferably a pulse wave form. A voltage pulse having a constant pulse peak value may be continuously applied, or a voltage pulse may be applied while a pulse peak value is increased. The forming treatment is not limited to the energization treatment, and a treatment for causing the electroconductive thin film 405 to generate an interval such as a crack to establish a high resistance state may also be used.

A device that has been subjected to the energization forming is desirably subjected to a treatment called activation. An activation treatment is a treatment for significantly changing a device current (a current flowing between the device electrodes 402 and 403) and an emission current (a device current emitted from the electron-emitting portion 404). For example, the activation treatment can be performed by repeating the application of a pulse as in the case of the energization forming under an atmosphere containing a carbon compound gas such as an organic substance gas. A preferable pressure of the organic substance at this time is appropriately set by case because the preferable pressure varies depending on, for example, the shape of a vacuum container in which a device is to be arranged and the kind of the organic substance.

The activation treatment causes an organic thin film composed of carbon or a carbon compound to be deposited from an organic substance present in an atmosphere onto the electroconductive thin film 405.

The activation treatment is performed while the device current and the emission current are measured, and is complete, for example, when the emission current is saturated. A voltage pulse is preferably applied by means of an operating drive voltage at the time of image display or a voltage higher than the operating drive voltage.

The formed crack may have electroconductive fine grains each having a grain size of 0.1 nm to several ten nanometers. The electroconductive fine grains contain at least one part of elements of the substance composing the electroconductive thin film 405. The electron-emitting portion 404 and the electroconductive thin film 405 near it may have carbon and a carbon compound.

The surface conduction electron-emitting device 120 may be formed on a plane perpendicular to the rear plate 101 (a perpendicular type) instead of a planar type in which the surface conduction electron-emitting device 120 is formed in a planar fashion on the surface of the rear plate 101. Furthermore, the electron source is not particularly limited as long as it is a device capable of emitting an electron when an image display apparatus using an electron-emitting device is taken as an example, and examples of such electron source include a thermal electron source using a thermal cathode and a field emission electron-emitting device.

Next, the arrangement of the surface conduction electron-emitting device 120 and a wiring for supplying an electrical (power) signal for image display to the electron-emitting device 120 will be described with reference to FIGS. 3, 4A and 4B.

For example, two wirings perpendicular to each other (Y: the upper wiring 102 and X: the lower wiring 103, they are referred to as simple matrix wirings) may be used. The upper wiring 102 and the lower wiring 103 are connected to the device electrodes 402 and 403 of the surface conduction electron-emitting device 120, respectively. Each of the upper wiring 102 and the lower wiring 103 can be composed of, for example, an electroconductive metal formed by vacuum evaporation, a printing method such as screen printing, or offset printing, or sputtering. The material, thickness, and width of each of the wirings are appropriately set. Of those, a printing method is preferably used because of its inexpensive production cost and ease of handling.

An electroconductive paste to be used contains any one of, or an arbitrary combination of, a noble metal such as Ag, Au, Pd, or Pt and a base metal such as Cu or Ni, and is burned at a temperature equal to or higher than 500° C. after a wiring pattern is printed by means of a printer. The thickness of, for example, each of the formed upper and lower printed wirings is about several micrometers to several hundred micrometers. Furthermore, the interlayer insulator 401 having a thickness of about several to several hundred micrometers obtained by printing and burning (at a temperature equal to or higher than 500° C.) a glass paste is interposed into at least a portion where the upper wiring 102 and the lower wiring 103 overlap, to thereby electrically insulate the wirings.

An end of the Y directional upper wiring 102 is electrically connected to a drive circuit portion as scanning-side electrode driving means because it applies a scanning signal as an image display signal for scanning a row on the Y side of the surface conduction electron-emitting device 120 in accordance with an input signal. Meanwhile, an end of the X directional lower wiring is electrically connected to a drive circuit portion as modulation signal driving means because it applies a modulation signal as an image display signal for modulating each column of the surface conduction electron-emitting device 120 in accordance with an input signal.

The phosphor film 202 applied to the inside of the face plate 201 is composed only of a single phosphor in the case where it is a monochrome phosphor film. However, in the case where the phosphor film 202 displays a color image, it takes a structure in which phosphors for emitting three primary colors (red, green, and blue) are separated by a black electroconductive material. The black electroconductive material is called a black stripe, a black matrix, or the like depending on its shape. Examples of a method of producing the phosphor film 202 includes a photolithography method and a printing method each using a phosphor slurry, and each of the method involves patterning the phosphor slurry into a pixel having a desired size to form a phosphor for each color.

The metal back film 203 as an anode electrode film is formed on the phosphor film 202. The metal back film 203 is composed of an electroconductive thin film made of Al or the like. The metal back film 203 reflects a light beam travelling toward the rear plate 101 as an electron source out of the light beams generated by the phosphor film 202, to thereby improve luminance. Furthermore, the metal back film 203 imparts-conductivity to an image display area of the face plate 201 to prevent charge from accumulating, and serves as an anode electrode for the surface conduction electron-emitting device 120 of the rear plate.101.

The metal back film 203 also has a function of, for example, preventing the phosphor film 202 from being damaged by ions generated by ionization of gases remaining in the face plate 201 and the image display apparatus by electron beams.

The metal back film 203 is electrically connected to a high voltage applying apparatus because a high voltage is to be applied to the metal back film 203.

The support 105 seals a space between the face plate 201 and the rear plate 101 in an airtight fashion. The support 105 is connected to the face plate 201 by means of indium (In) 205, and is connected to the rear plate 101 by means of the frit glass 106, whereby a hermetic container as an envelope is structured. The rear plate 101 and the support 105 may be connected to each other by means of In. The support 105 to be used may be formed of the same material as that of each of the face plate 201 and the rear plate 101, or may be formed of a glass, ceramic, metal, or the like having substantially the same coefficient of thermal expansion as that of each of the plates.

The support 105 and the ion pump casing 112 are desirably connected to the rear plate 101 before the electron-emitting portion 404 is formed. That is, they are desirably connected to the rear plate 101 by means of the frit glass 106 before forming/activation. When the support 105 is connected to the rear plate 101 by means of In, they are preferably connected when a hermetic container is to be formed of the face plate 201, the rear plate 101, and the support 105. For example, the support 105 is connected to the rear plate 101 by means of the frit glass 106.

Frit glasses that can be used in the present invention are classified into an $SiO_2$-based frit glass, a Te-based frit glass, a PbO-based frit glass, $V_2O_5$-based frit glass, and a Zn-based frit glass depending on their component systems. Any one of those frit glasses mixed with a refractory filler to adjust its coefficient a of thermal expansion can be appropriately used. Examples of the refractory filler include $PbTiO_3$, $ZrSiO_4$, $Li_2O$—$Al_2O_3$-$2SiO_2$, $2MgO$-$2Al_2O_3$-$5SiO_2$, $Li_2O$—$Al_2O_3$-$4SiO_3$, $Al_2O_3$—$TiO_2$, $2ZnO$—$SiO_2$, $SiO_2$, and $SnO_2$. A frit glass mixed with one kind, or several kinds, of those fillers can be appropriately used.

Burning in a vacuum involves foaming, so neither adhesive strength nor airtightness can be secured. It is preferable that pre-burning be performed in the atmosphere, and heating be performed in a vacuum to defoam a frit glass, followed by joining.

A frit glass is turned into a paste by means of an organic binder and the paste is applied to a connection portion because the frit glass is powder. A dispense method using an air pressure is generally used as a method of applying a frit glass in a paste state. A dipping method, a printing method, and the like can also be appropriately used. A pre-formed product can also be used, which is obtained by: forming a frit glass into a ring or a slot-like sheet; and subjecting the resultant to pre-burning and degassing.

When a frit glass is burned, the frit glass is in a state of hard starch sirup at a burning temperature. Therefore, an indentation pressure for crushing the sirup is needed, and an indentation pressure of 0.5 $g/mm^2$ or more is suitably used.

The ion pump casing 112 and the base plate 211 of the magnetic shield case are connected to the rear plate 101 by means of the frit glass 106 as in the case of the support 105.

The example in which the base plate 211 is bonded at a high temperature by means of the frit glass 106 has been described here, so a permalloy is used as a material for the base plate 211 of the magnetic shield case. If another method of bonding at a low temperature is used, any one of various magnetic sealing materials can be used, which include soft magnetic iron plate, electrolytic iron foil, a silicon steel plate, an amorphous alloy, and a nano-crystalline soft magnetic material.

Any one of various materials and bonding methods can be used for the ion pump casing 112 as long as good vacuum sealing property is obtained.

After the rear plate 101 connected with the support 105 and the ion pump casing 112, and the face plate 201 have been prepared, the washing of a substrate with an electron beam, the formation of the getter film 204 through evaporation, and the formation of a hermetic container as an envelope (connection of the rear plate 101 connected with the support 105 and the ion pump casing 112, and the face plate 201) are performed while a vacuum atmosphere is maintained.

Figure 6:
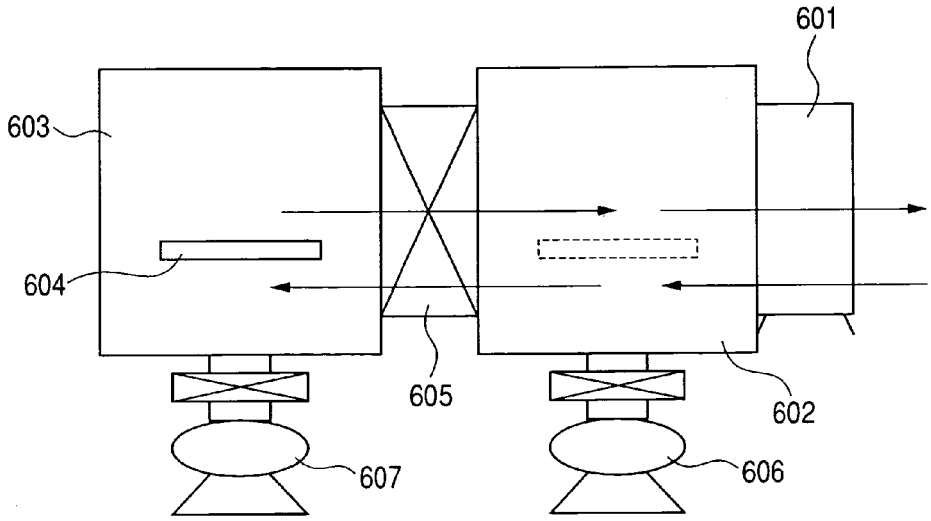
FIG. 6 is a schematic view showing the structure of a vacuum treatment apparatus to be used for producing an image display apparatus.

FIG. 6 is an overall schematic view showing a vacuum treatment apparatus to be used in the present invention. A load chamber 602 is used for carrying in and out a substrate. Treatments such as baking, getter film formation, and seal bonding are performed in a vacuum treatment chamber 603. A gate valve 605 is used for partitioning the load chamber 602 and the vacuum treatment chamber 603. The substrate is conveyed by a conveying jig 604. The load chamber 602 is evacuated to a vacuum by exhausting means 1 (606), and the vacuum treatment chamber 603 is evacuated to a vacuum by exhausting means 2 (607). The substrate is conveyed from and into an entrance 601.

Figure 7:
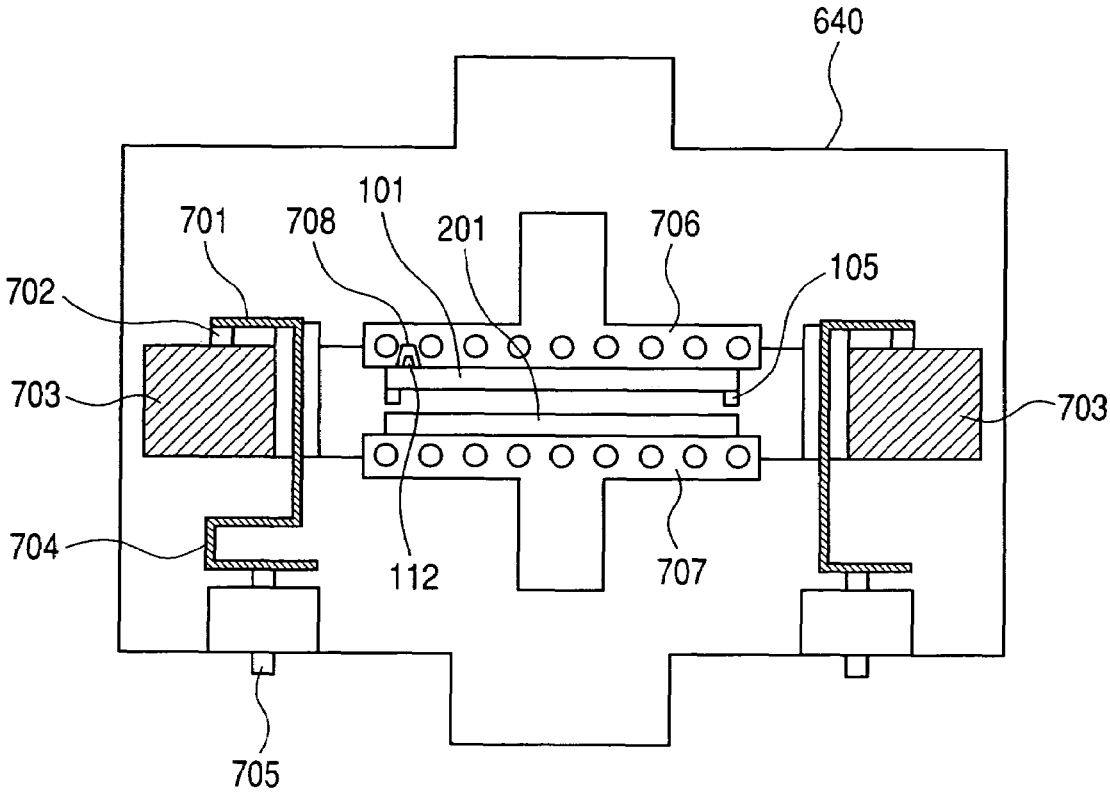
FIG. 7 is a view for explaining processes of baking, getter flashing, and seal bonding in a vacuum treatment chamber.

FIG. 7 shows a schematic view of a process to be performed in the vacuum treatment chamber 603. Reference numeral 706 denotes an upper hot plate, and reference numeral 707 denotes a lower hot plate. Other members identical to those described above are denoted by the same reference numerals.

As shown in FIG. 6, the entrance 601 of the load chamber 602 open to the atmosphere is opened. The face plate 201 on which the phosphor film 202 and the metal back film 203 are formed and the rear plate 101 connected with the support 105 and the ion pump casing 112 are mounted on the conveying jig 604. The chamber is evacuated to about $10^{-4}$ Pa or lower. Next, the gate valve 605 in communication with the vacuum treatment chamber 603 that has been evacuated to about $10^{-5}$ Pa in advance by the exhausting means 2 (607) is opened, the conveying jig 604 is conveyed to the vacuum treatment chamber 603, and the gate valve 605 is closed.

Any one of metals such as Ba, Mg, Ca, Ti, Zr, Hf, V, Nb, Ta, and W, and alloys of them may be used as a material for the getter film. It is preferable that any one of Ba, Mg, and Ca as alkali earth metals and alloys of them be appropriately used because of its low vapor pressure and ease of handling. Of those, Ba or an alloy containing Ba which is inexpensive, which can be readily evaporated from a metal capsule holding a getter material, and which can be easily produced industrially is preferable.

Next, FIG. 7 shows the outline of the production process to be performed in the vacuum treatment chamber 603. As shown in the figure, the face plate 201 and the rear plate 101 conveyed to the vacuum treatment chamber 603 are held by the upper hot plate 706 and the lower hot plate 707, respectively, and are subjected to degassing through baking. At this time, the rear plate 101 is present on the side of the upper hot plate 706, and a clearance portion 708 is formed in the upper hot plate 706 so as to prevent the ion pump casing 112 connected to the rear surface of the rear plate 101 from breaking. The baking temperature can be appropriately selected from the range of 50° C. to 400° C., and the plates are desirably treated as such high temperature as may be permitted by the heat resistance of the members. Next, the rear plate 101 is raised simultaneously with the vertical escape of the hot plate, to thereby make a space on the upper surface of the face plate 201. One cap-like jig 703 is moved into the space to be present on the face plate 201. A current is supplied from an outside power source through a getter brush-like contact electrode 705, a getter wiring terminal 704, and a getter wiring 702 to heat a getter, to thereby allow the getter to flash. Thus, the getter film 204 is formed on one half surface of the face plate 201.

Similarly, the getter film 204 is formed on the other half surface. Next, the cap-like jig 703 is escaped, and the face plate 201 filled with an In alloy or the like and the rear plate 101 connected in advance with the support 105 and the ion pump casing 112 are sandwiched at predetermined positions between the upper hot plate 706 and the lower hot plate 707, and a load is applied to the plates while the plates are heated, to thereby melt the In alloy. Thus, a vacuum container (vacuum envelope) surrounded by the face plate 201, the rear plate 101, and the support 105 is produced.

In the case of an image display apparatus for color display, the surface conduction electron-emitting device 120 is in one-to-one correspondence with a pixel (not shown) of the phosphor film 202, so the face plate 201 and the rear plate 101 are aligned with each other before they are subjected to vacuum seal bonding. After the bonding, the resultant is cooled to about room temperature. Next, the upper hot plate 706 and the lower hot plate 707 are escaped upward and downward, respectively, and the hermetic container is conveyed to the load chamber 602 and taken to the outside from the entrance 601.

Through the above process, the space surrounded by the rear plate 101, the support 105, and the face plate 201 is formed as a vacuum container capable of maintaining a pressure in it to the atmospheric pressure or lower in an airtight fashion.

The base plate of the magnetic shield case and the ion pump casing have been attached to the rear plate up to the above process. Next, the ion pump casing 112 is covered from outside with the magnetic shield case 210 attached with the magnet 208, followed by connection to the base plate 211. Next, the ion pump power source 207, and the anode connection terminal 110 and the cathode connection terminal 111 are wired and connected.

Through the above series of treatments, the vacuum container can serve as an image display apparatus. In the image display apparatus produced as described above, the ion pump power source 207 is turned on to operate the ion pump 209. Next, each surface conduction electron-emitting device 120 is provided with a scanning signal and a modulation signal as image signals by scanning driving means connected to the upper wiring 102 and modulation driving means connected to the lower wiring 103.

A drive voltage, that is an electrical signal is applied as a difference in voltage between the signals to cause a current to flow through the electroconductive thin film 405. An electron is emitted as an electron beam in accordance with the electrical signal from the electron-emitting portion 404 part of which is cracked. The electron beam is accelerated by a high voltage (1 to 10 kV) applied to the metal back film 203 and the phosphor film 202 to be bombarded with the phosphor film 202. Thus, a phosphor is allowed to emit light, to thereby display an image.

Here, purposes of the metal back film 203 includes: subjecting light travelling toward the inner surface of a phosphor to mirror reflection to the side of the face plate 201 to improve luminance; acting as an electrode for applying an electron beam accelerating voltage; and protecting the phosphor film 202 from any damage caused by the bombardment of a negative ion generated in the hermetic container.

The ion pump 209 starts to operate at an applied voltage of around 1 kV, and its exhaustion ability increases with increasing applied voltage. An increase in applied voltage involves large problems in that power consumption increases and in that insulation measures must be certainly taken. In view of this, a voltage of 2 to 5 kV is suitably used for efficiently driving the ion pump 209.

Once an image is displayed, an electron is emitted and gases are released from members in the image display apparatus. Of those gases, a gas such as $H_2$, $O_2$, CO, or $CO_2$ that is apt to damage an electron-emitting device is adsorbed by the getter film 204. Meanwhile, Ar, an inert gas, is not adsorbed by the getter film 204 but is exhausted by the ion pump 209 attached to the rear plate 101, so the Ar partial pressure can be suppressed to $10^{-6}$ Pa, which may affect a device, or lower. Thus, a damage by Ar to a device (mainly the breakage of a device by ion sputtering of ionized Ar) is suppressed. Accordingly, a long-life image display apparatus that shows no deterioration of luminance even if an image is displayed for a long period of time can be obtained.

Furthermore, according to the present invention, the magnet of the ion pump 209 is magnetically shielded by the magnetic shield case 210 as described above, and the communicating path with an image display portion is also magnetically shield. As a result, the frequency at which the trajectory of an electron beam is curved is very low, and hence good image display property can be maintained. In addition, the ion pump to be used has a small size and light weight, and is directly connected to the vacuum container such as the rear plate by means of a frit glass. As a result, the image display apparatus is thin and lightweight.

In the above description, the example in which a vacuum container is completed before a magnetic shield case is attached has been described. However, a magnetic shield case attached with a magnet may be seal-bonded in a vacuum and attached to the ion pump casing if the magnet of the ion pump 209 has sufficient heat resistance. Alternatively, the shield case may be attached by means of an adhesive having good vacuum sealing property as required or otherwise.

In FIG. 1, the base plate 211 of the magnetic shield case and the ion pump casing 112 are joined by means of the frit glass 106. Alternatively, they may be integrally formed or may be bonded by means of bonding means except the frit glass. Any one of metals and non-metal materials such as glass may be used for the ion pump casing 112 as long as the material can resist a vacuum.

The structure of the image display apparatus of the present invention is also effective for, for example, an image display apparatus using a field emission electron-emitting device instead of a surface conduction electron-emitting device as the electron source or an image display apparatus that controls an electron beam emitted from an electron source by means of a control electrode (a grid electrode wiring) instead of a simple matrix type to display an image.

EMBODIMENT

Hereinafter, the embodiments of the present invention will be described with reference to the drawings. However, the present invention is not limited to these embodiments, and modifications can be appropriately made without departing from the gist of the present invention.

Embodiment 1

The structure of an image display apparatus attached with an ion pump with a magnetic shielding member arranged between an electron-emitting device and the ion pump will be described with reference to FIG. 1 and FIGS. 2A, 2B-1, and 2B-2, and a method of producing a vacuum container serving as the image display apparatus will be described with reference to FIGS. 3 to 7.

First, a method of producing a hermetic container as an image display apparatus will be described. Soda glass having a thickness of 2.8 mm and a size of 240 mm×320 mm (SL: manufactured by Nippon Sheet Glass Co., Ltd.) was used as the rear plate 101, and soda glass having a thickness of 2.8 mm and a size of 190 mm×270 mm (SL: manufactured by Nippon Sheet Glass Co., Ltd.) was used as the face plate 201.

The exhaust port 107 of 8 mmΦ was opened in the rear plate 101 at a position outside an image area and inside the glass frame 105.

The device electrodes 402 and 403 of the surface conduction electron-emitting device 120 as an electron source were produced by: forming platinum into a film on the rear plate 101 by means of an evaporation method; and processing the film by means of a photolithography technique (including a processing technique such as etching or lift-off) into shapes each having a thickness of 100 nm and a device electrode length W of 300 μm with an electrode interval L of 2 μm between them.

Next, the upper wirings 102 (100 wirings) each having a width of 500 μm and a thickness of 12 μm, and the lower wirings 103 (600 wirings) each having a width of 300 μm and a thickness of 8 μm were formed on the rear plate 101 by printing and burning Ag paste ink. Leading terminals to external drive circuits were similarly produced. The interlayer insulator 401 was produced by printing and burning (at a burning temperature of 550° C.) glass paste, and had a thickness of 20 μm.

Next, the rear plate 101 was washed. A dilution of dimethyldiethoxysilane (DDS: manufactured by Shin-Etsu Chemical Co., Ltd.) in ethyl alcohol was sprayed by means of a spray method to the plate, and then the whole was heated and dried at 120° C. The electroconductive thin film 405 of 60 μmΦ was produced by: dissolving 0.15 wt % of a palladium-proline complex into an aqueous solution composed of 85% of water and 15% of isopropyl alcohol; applying the organic palladium-containing solution by means of an ink jet applying apparatus; and heating the applied solution at 350° C. for 10 minutes to form a fine grain film composed of palladium oxide (PdO) as the electroconductive film 405.

The support 105 had a thickness of 2 mm, an outer shape of 150 mm×230 mm, and a width of 10 mm, and soda glass (SL; manufactured by Nippon Sheet Glass Co., Ltd.) was used as a material of the support 105. An LS7305 (manufactured by Nippon Electric Glass Co., Ltd.) as a frit glass was applied by means of a dispenser to the surface of the support 105 to be connected to the rear plate 101. After that, the resultant was heated and burned at 430° C. for 30 minutes.

The ion pump used in this embodiment is a bipolar ion pump. In the ion pump, the cylindrical anode electrode 108 and the flat plate-like cathode electrode 109 opposed to the flat plate portion of the cylinder are each formed of SUS, and a rod-like Ti electrode 113 is connected to the central portion of the cathode electrode 109. Those electrodes are arranged in the ion pump casing 112 composed of soda glass, and the cathode connection terminal 111 and the anode connection terminal 110 connected to the cathode electrode 109 and the anode electrode 108 respectively are drawn to the outside of the ion pump casing 112.

Soda glass molded into a size capable of accommodating the cathode electrode 109 and the anode electrode 108 (measuring 15 mm wide by 25 mm deep by 25 mm high) was used for the ion pump casing 112. The cathode connection terminal 111 and the anode connection terminal 110 were fixed by a frit to allow a current to be introduced from outside.

As shown in FIG. 2A, the base plate 211 of the magnetic shield case was produced by spot-welding a mesh material composed of a permalloy of 0.3 mmΦ with an interval of 1 mm (the mesh shaped member 221) to a 1.5 mm-thick permalloy plate perforated with a hole.

Next, the support 105 to which the frit glass 106 had been applied, the base plate 211 of the magnetic shield, and the ion pump casing 112 were fixed by means of predetermined jigs, and a load was applied to a fulcrum for supporting them. The resultant was heated to 430° C. by means of an oven, and held at the temperature for 30 minutes to bond the support 105, the meshed base plate 211 of the magnetic shield, and the ion pump casing 112 to the rear plate 101.

Figure 5:
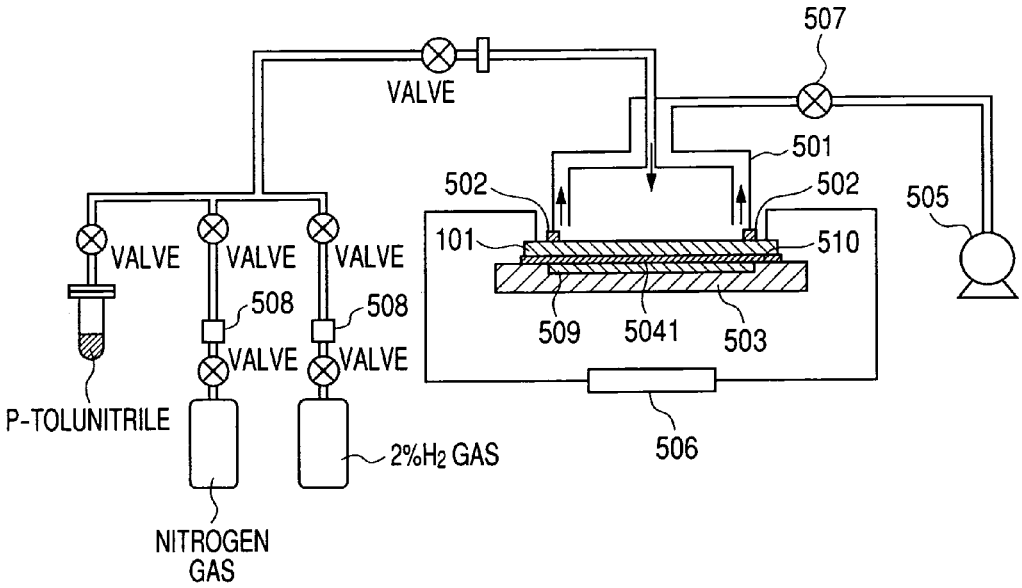
FIG. 5 is a view for explaining a forming/activation process.

The rear plate 101 thus produced was subjected to the following forming and activation by means of a vacuum pumping apparatus shown in FIG. 5. First, as shown in FIG. 5, a region of the rear plate 101 placed on a substrate stage 503 except a lead out electrode (not shown) was sealed with an O ring 502, and was covered with a vacuum container 501. A clearance portion (not shown) was formed on the substrate stage 503 so as not to be in contact with the ion pump casing 112, and had an electrostatic chuck 504 for fixing the rear plate 101 on the stage. A voltage of 1 kV was applied between an ITO film 510 formed on the rear surface of the rear plate 101 and an electrode inside the electrostatic chuck to chuck the rear plate 101.

Next, the inside of the vacuum container was exhausted by means of a magnetically levitated turbo-molecular pump 505, and the process subsequent to the forming process was-performed as follows.

First, the inside of the,vacuum container was evacuated to $10^{-4}$ Pa or lower, and a rectangular wave form having a pulse width of 1 msec was sequentially applied to the upper wirings 102 at a scroll frequency of 10 Hz and a voltage of 12 V. The lower wirings were connected to the ground. A mixed gas of hydrogen and nitrogen (2% $H_2$, 98% $N_2$) was introduced into the vacuum container, and the pressure of the gas was kept at 1,000 Pa. The gas introduction was controlled by means of a massflow controller 508. Meanwhile, an exhaust flow rate from the vacuum container was controlled by means of the pumping apparatus and a conductance valve 507 for flow rate control. Voltage application was terminated when the value of current flowing through the electroconductive thin film 405 became close to zero. The inside of the vacuum container was exhausted of the mixed gas of $H_2$ and $N_2$ to complete forming. A crack was formed on the entire elect roconductive thin film 405 of the rear plate 101 to produce the electron-emitting portion 404.

Next, an activation process was performed. The vacuum container 501 was evacuated to $10^{-5}$ Pa, and tolunitrile (having a molecular weight of 117) at a partial pressure of $1\times10^{-3}$ Pa was introduced into the vacuum container. A voltage was applied in time division (scroll) to 10 lines of the upper wirings 102. All devices were activated by means of a rectangular wave of both electrodes under voltage application conditions of: a peak value of ±14 V and a pulse width of 1 msec.

After the completion of the activation, the vacuum container 501 was exhausted of the remaining tolunitrile before the pressure was returned to the atmospheric pressure to take out the rear plate 101.

Next, In was applied to the support 105 to place spacers 206 at intervals of 20 lines on the upper wirings 102. The spacers 206 were bonded and fixed by means of an Aron Ceramic W (manufactured by Toa Gosei Co., Ltd.) to an insulating board arranged outside the image display area.

Meanwhile, stripe shaped phosphors (R, G, and B) and a black electroconductive material (black stripe) were alternately formed as the phosphor film 202 on the face plate 201. The metal back film 203 composed of an aluminum thin film and having a thickness of 200 nm was formed on the phosphor film. Next, In was applied to a silver paste pattern arranged in advance on the circumferential portion of the face plate 201.

The rear plate 101 to which the support 105 and the ion pump casing 112 had been connected by means of frit and the face plate 201 to which In had been applied were set on the conveying jig 604. The entrance 601 of the vacuum treatment apparatus shown in FIG. 6 was opened, and the jig was loaded into the load chamber 602 at the atmospheric pressure. After the entrance 601 had been closed, the pressure of the load chamber 602 was lowered to about $3\times10^{-5}$ Pa. Then, the gate valve 605 was opened, the conveying jig 604 was conveyed to the vacuum treatment chamber 603 having a pressure lowered to about $1\times10^{-5}$ Pa in advance by the exhausting means 2, and the gate valve 605 was closed. After the conveying jig 604 had been placed at a predetermined position, the upper hot plate 706 and the lower hot plate 707 were brought into close contact with the rear plate 101 and the face plate 201, respectively as shown in FIG. 7, and the whole was heated at 300° C. for 1 hour.

Next, the rear plate 101 and part of the conveying jig 604 supporting the plate were raised together with the upper hot plate 706 by about 30 cm. Next, the other cap-like jig 703 was moved on the face plate 201 in a space between the rear plate 101 and the face plate 201. A current of 12 A was applied sequentially for periods of 10 seconds each to a container of a Ba getter placed on the inner ceiling of the cap-like jig 703, to thereby allow the Ba film to the metal back film 203 of the face plate 201 by 50 nm. The cap-like jig 703 was returned to the original position, and the same operation was performed on the other cap-like jig 703.

Next, the cap-like jig 703 was returned to the original position. The rear plate 101, a support member as the part of the conveying jig 604, and the upper hot plate 706 were lowered, and the upper hot plate 706 and the lower hot plate 707 were heated to 180° C. After the plates had been kept at 180° C. for 3 hours, the rear plate 101, the support member as the part of the conveying jig 604, and the upper hot plate 706 were additionally lowered to apply a load of 60 kg/cm$^2$ to the rear plate 101, the face plate 201, and the support 105. The heating was stopped in this state, and the whole was naturally cooled to room temperature to complete seal bonding.

The gate valve 605 was opened, and the vacuum container was conveyed from the vacuum treatment chamber 603 to the load chamber 602. After the gate valve 605 had been closed, the pressure of the load chamber 602 was returned to the atmospheric pressure, and the hermetic container was conveyed from the entrance 601. The hermetic container produced as described above did not have any crack, split, or the like.

Next, the ion pump was covered from outside with the magnetic shield case 210 bonded with the magnet 208. The magnetic shield case 210 was formed of a permalloy plate having a thickness of 1.5 mm, and spot-welded with the base plate 211 of the permalloy.

The hermetic container was connected to a voltage applying apparatus and a high voltage applying apparatus by means of a cable so as to be capable of displaying an image. Furthermore, the anode connection terminal 110 and cathode connection terminal 111 of the ion pump casing 112 were wired and connected to the ion pump power source 207 by wiring, to thereby assemble an image display apparatus.

Next, a voltage of 3 kV was applied to the ion pump power source 207 to drive the ion pump 209. In addition, image signals were supplied from the voltage applying apparatus connected to the image display apparatus to the electron-emitting devices. Simultaneously with the supply, a high voltage of 10 kV was applied from the high voltage applying apparatus to allow the surface conduction electron-emitting devices 120 to emit light, thereby allowing the image display apparatus to display an image.

The luminance distribution of the image display apparatus was measured. As a result, a reduction in luminance was suppressed to 6% or less even in the vicinity of the ion pump as compared to the central portion of the image display area. In the case where no mesh member for magnetic shielding was used (this case corresponds to a comparative example), a maximum reduction in luminance of 25% was observed in the vicinity of the ion pump as compared to the central portion of the image display area. A reduction in luminance of a pixel in the vicinity of the ion pump is small in the present invention because the degree to which the trajectory of an electron beam is curved owing to a leaked magnetic field is suppressed.

In addition, the image display apparatus was allowed to continuously display an image in order to evaluate the apparatus for life time. A time required for the luminance to reduce by half was measured. The required time was 15,000 hours. No unevenness occurred in the vicinity of the ion pump.

As described above, the image display apparatus produced in this embodiment had small unevenness in luminance, showed uniform display, and was small, lightweight, highly reliable, inexpensive, and long-life owing to an effect of the ion pump.

Embodiment 2

As shown in FIGS. 2B-1 and 2B-2, a base plate of a magnetic shield case was produced by: perforating a permalloy plate having a thickness of 1.5 mm with holes; and attaching, to the hole portions, 4 stripe shaped permalloy plates each having a thickness of 0.3 mm and a width of 3 mm by means of spot-welding in such a manner that a width direction would be perpendicular to the surface of the base plate. Each stripe shaped plate had such length that would be stored in the communicating path 107 arranged in the rear plate. Then, an image display apparatus and an ion pump were produced in the same manner as in Embodiment 1 except that the portions of the stripe shaped plates were placed into the communicating path arranged in the rear plate and the base plate was bonded by means of frit glass.

The luminance distribution of the image display apparatus produced in Embodiment 2 was measured. As a result, a reduction in luminance was suppressed to 4% or less even in the vicinity of the ion pump.

Embodiment 3

In each of Embodiments 1 and 2, a glass member having a coefficient of thermal expansion close to that of frit glass was used for the ion pump casing 112 because the ion pump casing was connected to the rear plate 101 by means of the frit glass 106. In the case where glass is used, there is no need to electrically insulate the anode connection terminal 110, but the terminal must be vacuum-sealed with frit glass or the like.

In Embodiment 3, a stainless case was used for the ion pump casing 112. In this case, electrical glass made of alumina was used for electrically insulating the anode connection terminal 110.

Bonding of the base plate 211 of the permalloy magnetic shield case with the rear plate 101, and bonding of the ion pump casing 112 with the base plate 211 were each performed by means of an epoxy-based adhesive. The rear plate and the face plate were subjected to seal bonding in a vacuum at 100° C. An image display apparatus and an ion pump were produced in the same manner as in Embodiment 1 except the foregoing.

The luminance distribution of the image display apparatus produced in Embodiment 3 was measured. As a result, a reduction in luminance was suppressed to 5% or less even in the vicinity of the ion pump, so a magnetic shielding effect of the base plate was similarly observed. In addition, the image display apparatus was allowed to continuously display an image in order to evaluate the apparatus for life time. A time required for the luminance to reduce by half was measured. The required time was 10,000 hours. No unevenness occurred in the vicinity of the ion pump.

This application claims priority from Japanese Patent Application No. 2004-248612 filed Aug. 27, 2004, which is hereby incorporated by reference herein.

What is claimed is:

1. An image display apparatus, comprising:

a vacuum container formed of at least an electron source substrate on which multiple electron-emitting devices are arranged, and an image forming substrate which is arranged so as to be opposite to the electron source substrate and which has a phosphor film and an anode electrode film;

(a) an ion pump having an ion pump casing and magnetic field forming means, the ion pump casing being connected with the vacuum container through a communicating path arranged on at least one of the electron source substrate and the image forming substrate to maintain a pressure inside the ion pump casing at a reduced pressure; and (b) a first magnetic shielding member arranged in a space where the ion pump and the electron-emitting devices are in communication with each other, wherein:

the first magnetic shielding member allows a gas to flow between the vacuum container and the ion pump casing, the first magnetic shielding member has one or more flowing through holes, the first magnetic shielding member has one of a mesh shaped member and a stripe shaped member in the space, through which the ion pump and the electron-emitting devices are in communication with each other, and the one of the mesh shaped member and the stripe shaped member allows a gas to flow therethrough.

2. An image display apparatus according to claim 1, wherein the one of the mesh shaped member and the stripe shaped member is arranged outside the communicating path.

3. An image display apparatus according to claim 1, wherein the one of the mesh shaped member and the stripe shaped member is arranged within the communicating path.

4. An image display apparatus according to claim 1, wherein:

the first magnetic shielding member has the one of the mesh shaped member and the stripe shaped member arranged in an opening of a flat plate; and a portion of the flat plate where the opening is not present is joined with the vacuum container.

5. An image display apparatus according to claim 1, wherein:

the magnetic field forming means is arranged outside the ion pump casing; and a second magnetic shielding member is arranged so as to cover the magnetic field forming means from outside the ion pump casing.

6. An image display apparatus according to claim 5, wherein the magnetic field forming means is spatially surrounded by the first magnetic shielding member and the second magnetic shielding member.

* * * * *